US006929349B2

(12) United States Patent
Bell et al.

(10) Patent No.: US 6,929,349 B2
(45) Date of Patent: Aug. 16, 2005

(54) THIN FILM INK JET PRINTHEAD ADHESION ENHANCEMENT

(75) Inventors: Byron V. Bell, Paris, KY (US); Yimin Guan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 128 days.

(21) Appl. No.: 10/685,115

(22) Filed: Oct. 14, 2003

(65) Prior Publication Data

US 2005/0078151 A1 Apr. 14, 2005

(51) Int. Cl.[7] ..... B41J 2/135
(52) U.S. Cl. ..... 347/44
(58) Field of Search ..... 347/44, 47, 54, 347/61, 62, 63, 64, 68, 71, 72; 438/376, 105, 618, 622, 628, 644; 29/890.1

(56) References Cited

U.S. PATENT DOCUMENTS

| | | | |
|---|---|---|---|
| 4,335,389 A | 6/1982 | Shirato et al. | |
| 4,596,994 A | 6/1986 | Matsuda et al. | |
| 4,663,640 A | 5/1987 | Ikeda | |
| 4,956,653 A | 9/1990 | Braun | |
| 4,965,611 A | 10/1990 | Pan et al. | |
| 5,448,273 A | 9/1995 | Klein et al. | |
| 5,682,188 A | 10/1997 | Meyer et al. | |
| 6,441,838 B1 | 8/2002 | Hindman et al. | |
| 6,450,622 B1 | 9/2002 | Nguyen et al. | |
| 2003/0042046 A1 | 3/2003 | Japp et al. | |
| 2003/0087484 A1 | 5/2003 | Vyvoda et al. | |
| 2003/0089597 A1 | 5/2003 | Tang et al. | |
| 2004/0113988 A1 * | 6/2004 | Silverbrook | 347/56 |

* cited by examiner

*Primary Examiner*—Raquel Yvette Gordon
(74) *Attorney, Agent, or Firm*—Leudeka, Nuly & Graham, P.C.

(57) ABSTRACT

An ink jet printhead for an ink jet printer and method for making an improved printhead. The printhead includes a nozzle plate attached to a heater chip. The heater chip is a semiconductor substrate having a resistive layer deposited on the substrate, a dielectric layer deposited on the resistive layer, a cavitation layer for contact with ink, and an adhesion layer between the dielectric layer and cavitation layer. The adhesion layer is selected from the group consisting of tantalum nitride (TaN), tantalum oxide (TaO), silicon nitride (SiN), and titanium nitride (TiN), provided the adhesion layer and cavitation layer are selected so that the adhesion layer has no elemental component in common with the cavitation layer when the dielectric layer is comprised of SiC/SiN. Adhesion between the dielectric layer and cavitation layer is significantly enhanced by the invention.

14 Claims, 5 Drawing Sheets

THIN FILM INK JET PRINTHEAD ADHESION ENHANCEMENT

FIELD OF THE INVENTION

The invention relates to compositions and methods that enhance adhesion between cavitation layer and an underlying dielectric layer for an ink jet printhead.

BACKGROUND OF THE INVENTION

In the production of ink jet printheads, a cavitation layer is typically provided as an ink contact layer. The cavitation layer is needed to prevent damage to the underlying dielectric and resistive layers during ink ejection. As ink is heated in an ink chamber by a heater resistor, a bubble is formed that forces ink out of the ink chamber and through an ink ejection orifice. After the ink is ejected, the bubble collapses causing mechanical shock to the thin metal layers comprising the ink ejection device. In a typical printhead, tantalum (Ta) is used as a cavitation layer. The Ta layer is deposited on a dielectric layer such as silicon carbide (SiC) or a composite layer of SiC and silicon nitride (SiN). In the composite layer, SiC is adjacent to the Ta layer.

Under NMOS printhead chip manufacturing process conditions, there is sufficient adhesion between the Ta layer and the SiC layer. However, due to higher processing temperatures such as for printhead chips produced containing CMOS devices, delamination between the Ta layer and the dielectric layer becomes a significant problem. If the cavitation layer delaminates from the dielectric layer, ink will penetrate into cracks and corrode the dielectric layer and underlying heater layer which will result in heater failure. In addition, heat transfer from the heater film to the ink will be degraded, thereby adversely affecting print quality. Accordingly, there is a need to provide thin film structures for ink jet printheads that have increased adhesion between the cavitation layer and underlying dielectric layer.

SUMMARY OF THE INVENTION

With regard to the above, the invention provides an ink jet printhead for an ink jet printer having improved adhesion between thin film layers. The printhead includes a nozzle plate attached to a heater chip wherein the heater chip includes a semiconductor substrate, a resistive layer deposited on the substrate, a dielectric layer deposited on the resistive layer, a cavitation layer for contact with ink, and an adhesion layer between the dielectric layer and cavitation layer. The dielectric layer is selected from the group consisting of silicon carbide/silicon nitride (SiC/SiN), diamond-like carbon (DLC), and doped DLC. The cavitation layer is selected from the group consisting of tantalum (Ta), titanium (Ti), and platinum (Pt). The adhesion layer is selected from the group consisting of tantalum nitride (TaN), tantalum oxide (TaO), silicon nitride (SiN), and titanium nitride (TiN). The adhesion layer and cavitation layer are preferably selected so that the adhesion layer has no elemental component in common with the cavitation layer when the dielectric layer is comprised of SiC/SiN.

In another embodiment, the invention provides a method for enhancing adhesion between a dielectric layer and a cavitation layer of an ink jet printhead heater chip. The method includes the steps of providing a semiconductor substrate, and depositing an insulating layer on the substrate. The insulating layer having a thickness ranging from about 8,000 to about 30,000 Angstroms. A resistive layer is deposited on the insulating layer. The resistive layer has a thickness ranging from about 500 to about 2000 Angstroms and is preferably selected from the group consisting of TaAl, $Ta_2N$, TaAl(O,N), TaAlSi, TaSiC, Ti(N,O), WSi(O,N), TaAlN, and TaAl/Ta. A first metal layer is deposited on the insulating layer. The first metal layer is etched to define ground and address electrodes and a heater resistor therebetween and has a thickness ranging from about 4,000 to about 15,000 Angstroms. A dielectric layer is deposited on the heater resistor. The dielectric layer has a thickness ranging from about 1000 to about 8000 Angstroms and is selected from the group consisting of silicon carbide/silicon nitride (SiC/SiN), diamond-like carbon (DLC), and doped-DLC. An adhesion layer is provided on the dielectric layer. The adhesion layer has a thickness ranging from about 100 to about 1000 Angstroms and is selected from the group consisting of tantalum nitride (TaN), tantalum oxide (TaO), silicon nitride (SiN), and titanium nitride (TiN). A cavitation layer is deposited on the adhesion layer. The cavitation layer has a thickness ranging from about 1,500 to about 8,000 Angstroms and being selected from the group consisting of tantalum (Ta), titanium (Ti), and platinum (Pt). The adhesion layer and cavitation layer are preferably selected so that the adhesion layer has no elemental component in common with the cavitation layer when the dielectric layer is SiC/SiN.

An advantage of the invention is that enhanced adhesion between the dielectric layer and cavitation layer is provided particularly for ink jet printhead chips made with CMOS technology. The adhesion layer may be applied with very little or no added cost while significantly increasing the adhesion between the thin metal layers. A secondary benefit of the invention is that the more adherent cavitation layer may have equivalent functionality with reduced thickness thus saving material cost and enabling more energy efficient ink ejection.

BRIEF DESCRIPTION OF THE DRAWINGS

Further advantages of the invention will become apparent by reference to the detailed description of preferred embodiments when considered in conjunction with the following drawings, in which like reference numbers denote like elements throughout the several views, and wherein.

Figure 1:
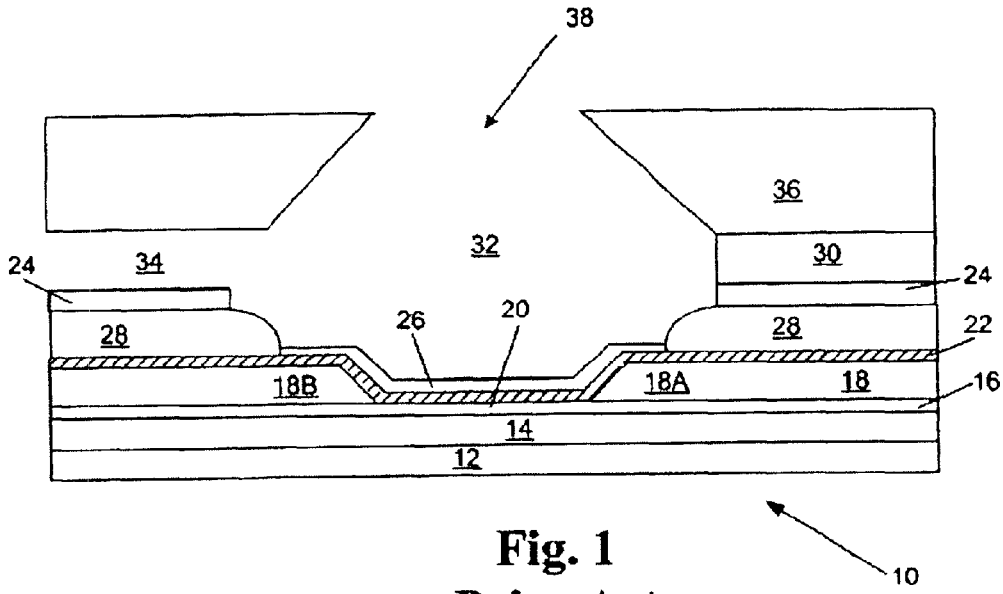
Fig. 1 Prior Art
FIG. 1 is a cross-sectional view, not to scale, of a portion of a conventional ink jet printhead.

DETAILED DESCRIPTION OF THE PREFERRED EMBODIMENTS:

With reference to FIG. 1, a cross-sectional view, not to scale, of a portion of a conventional ink jet printhead 10 is provided. The printhead 10 includes a semiconductor substrate 12 made of silicon, an insulating layer 14, such as silicon nitride (SiN), silicon dioxide ($SiO_2$), phosphorous doped glass (PSG) or boron and phosphorous doped glass (BSPG) deposited or grown on the semiconductor substrate.

The insulating layer 14 has a thickness ranging from about 8,000 to about 30,000 Angstroms. The semiconductor substrate 12 typically has a thickness ranging from about 100 to about 800 microns or more.

A resistive layer 16 is deposited on the insulating layer 14. The resistive layer 16 is typically selected from TaAl, $Ta_2N$, TaAl(O,N), TaAlSi, TaSiC, Ti(N,O), WSi(O,N), TaAlN and TaAl/Ta has a thickness ranging from about 500 to about 1500 Angstroms.

A first metal layer 18 is deposited on the resistive layer 16 and is etched to provide power and ground conductors 18A and 18B for a heater resistor 20 defined between the power and ground conductors 18A and 18B. The first metal layer 18 may be selected from conductive metals; including, but not limited to, gold, aluminum, silver, copper, and the like and has a thickness ranging from about 4,000 to about 15,000 Angstroms.

A dielectric layer 22 is deposited on the heater resistor 20 and first metal layer 18 to provide insulation of the first metal layer 18 and to protect the heater resistor 20 from ink corrosion. The dielectric layer 22 typically consists of composite layers of silicon nitride (SiN) and silicon carbide (SiC) with SiC being the top layer. The dielectric layer 22 has a thickness ranging from about 1000 to about 8000 Angstroms.

A cavitation layer 26 is then deposited on the dielectric layer overlying the heater resistor 20. The cavitation layer 26 has a thickness ranging from about 1,500 to about 8,000 Angstroms and is typically composed of tantalum (Ta). The cavitation layer 26, also referred to as the "ink contact layer" provides protection of the heater resistor 20 from erosion due to bubble collapse and mechanical shock during ink ejection cycles.

Overlying the dielectric layer 22 is another insulating layer or dielectric layer 28 typically composed of epoxy photoresist materials, polyimide materials, silicon nitride, silicon carbide, silicon dioxide, spun-on-glass (SOG), laminated polymer and the like. The insulating layer 28 provides insulation between the second metal layer 24 and the underlying dielectric layer 22 and first metal layer 18 and has a thickness ranging from about 5,000 to about 20,000 Angstroms.

In some prior art printheads, a thick polymer film layer 30 is deposited on the second metal layer 24 to define an ink chamber 32 and ink channel 34 therein. The ink channel 34 provides ink to the ink chamber 32 for heating by the heater resistor 20 for ejection through a nozzle hole 38 in a nozzle plate 36 attached to the thick film layer 30. In other ink jet printheads, the thick film layer 30 may be eliminated and the ink channel and ink chamber formed integral with the nozzle plate in the nozzle plate material.

One disadvantage of the prior art printhead 10 described above is that under some printhead fabrication conditions such as temperatures used in CMOS fabrication techniques, delamination between the cavitation layer 26 and dielectric layer 22 has been experienced. Without desiring to be bound by theory, there are believed to be four types of interfaces existing between thin film material layers: (1) abrupt interfaces, (2) compound interfaces, (3) diffusion interfaces, and (4) mechanical anchoring interfaces. The last three types promote good adhesion between the layers. However, adhesion between the cavitation layer 26 and the dielectric layer 22 is believed to be an abrupt interface. Accordingly, because of the elevated processing temperatures experienced during CMOS fabrication and the difference in thermal expansion coefficients between the dielectric layer 22 and cavitation layer 26, undesirable delamination may occur. Delamination between the cavitation layer 26 and dielectric layer 22 will significantly shorten printhead life by allowing ink over time to attack and corrode the less resistant dielectric layer 22 and heater resistor 20. Delamination will reduce or otherwise degrade heat transfer from the heater resistor 20 to the ink, thereby adversely affecting print quality.

The invention improves upon the prior art printhead design by providing an adhesion layer between the dielectric layer and the cavitation layer or ink contact layer. By proper selection of the adhesion layer, a compound interface, diffusion interface or mechanical anchoring of the layers may be provided. The adhesion layer is of particular benefit in printheads containing a dielectric layer composed of diamond-like carbon (DLC) or doped-DLC. Features of the invention will now be described with reference to FIGS. 2 and 3.

Figure 2:
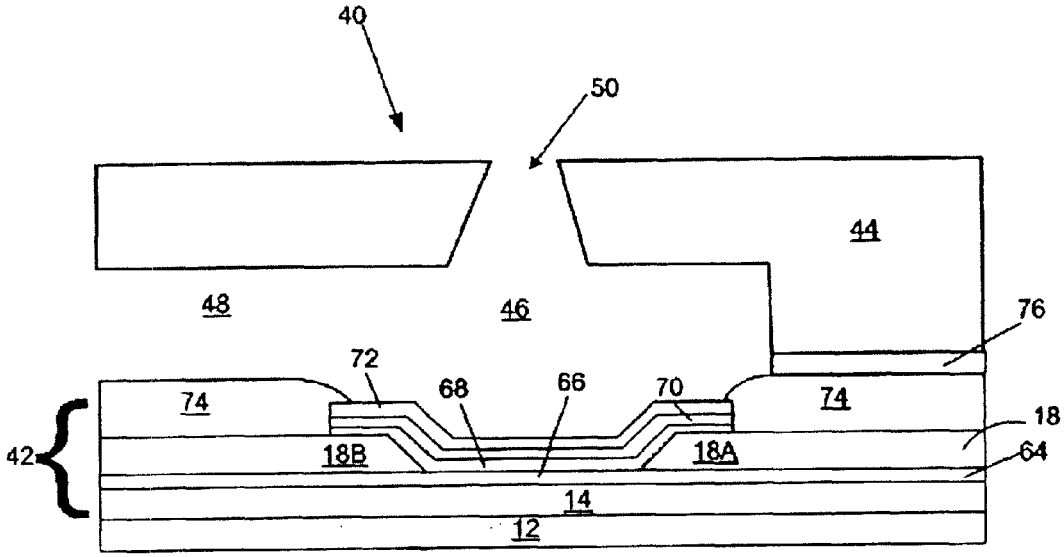
FIG. 2 is a cross-sectional view, not to scale, of a portion of a printhead according to the invention.

With reference to FIG. 2, a printhead 40 containing a heater chip 42 and nozzle plate 44 attached to the heater chip 42 is provided. In the embodiment shown in FIG. 2, the nozzle plate 44 has a thickness ranging from about 5 to about 20 microns and is preferably made from an ink resistant polymer such as polyimide. Flow features such as an ink chamber 46, ink channel 48 and nozzle hole 50 are formed in the nozzle plate 44 by conventional techniques such as laser ablation.

Figure 3:
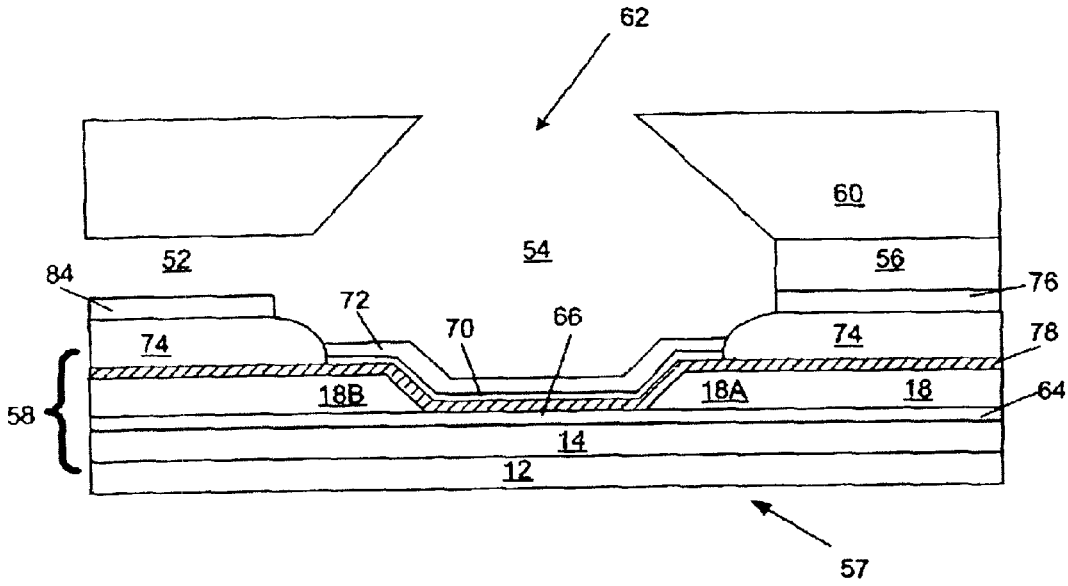
FIG. 3 is a cross-sectional view, not to scale, of a portion of another printhead according to the invention.

An alternative nozzle plate construction is illustrated in FIG. 3. According to the alternative construction, the ink channel 52 and ink chamber 54 are formed in a separate thick film layer 56 attached to the heater chip 58. A nozzle plate 60 containing a nozzle hole 62 is attached to the thick film layer 56 to provide a printhead 57 according to the invention.

With reference again to FIG. 2, the heater chip 42 includes a semiconductor substrate 12 and insulating layer 14 as described above. A resistive layer 64 selected from the group consisting of TaAl, $Ta_2N$, TaAl(O,N), TaAlSi, TaSiC, Ti(N,O), WSi(O,N), TaAlN, and TaAl/Ta is deposited on the insulating layer 14. The resistive layer 64 preferably has a thickness ranging from about 500 to about 2000 Angstroms. A particularly preferred resistive layer 64 is composed of TaAl. However, the invention is not limited to any particular resistive layer as a wide variety of materials known to those skilled in the art may be used as the resistive layer 64.

Next a first metal layer 18 is deposited on the resistive layer 64 and is etched to define a heater resistor 66 and conductors 18A and 18B as described above. As before, the first metal layer 18 may be selected from conductive metals, including, but not limited to, gold, aluminum, silver, copper, and the like.

A dielectric layer 68 is then deposited over a least a portion of the resistive layer 64 and at least a portion of the conductors 18A and 18B. The dielectric layer 68 is preferably selected from a dual layer of silicon carbide/silicon nitride (SiC/SiN), diamond-like carbon (DLC), and doped DLC. Doped-DLC includes, but is not limited to silicon-doped DLC (Si-DLC), and nitrogen-doped DLC (N-DLC). The dielectric layer 68 preferably has a thickness ranging from about 1000 to about 8000 Angstroms.

An adhesion layer 70 is deposited, or as described below, grown on the dielectric layer 68 to provide enhanced adhesion between the dielectric layer 68 and a cavitation layer 72. According to the invention, the cavitation layer 72 is preferably selected from tantalum (Ta), titanium (Ti), or platinum (Pt) and has a thickness ranging from about 1,500 to about 8,000 Angstroms. Hence, in order to promote adhesion of the cavitation layer 72 to the heater chip 42, a particular adhesion layer 70 is provided.

In the case of a DLC or doped-DLC dielectric layer 68, the adhesion layer is preferably selected from a metal nitride or metal oxide such as tantalum nitride (TaN), tantalum oxide (TaO), silicon nitride (SiN), and titanium nitride (TiN), and the like. However, when the dielectric layer 68 is a SiC/SiN composite layer, it is preferred that the adhesion layer have no elemental component in common with the cavitation layer 72. For example, a heater chip 42 having a SiC/SiN dielectric layer 68 and a titanium cavitation layer 72 preferably has a TaO, TaN, or SiN adhesion layer 70. A heater chip 42 having a tantalum cavitation layer 72 instead of the titanium cavitation layer 72 preferably has a TiN, TiO or SiN adhesion layer. The adhesion layer preferably has a thickness of less than about 1000 Angstroms.

The adhesion layer 70 is desirable because the adhesion between a cavitation layer 72 and a diamond-like carbon (DLC) or SiC/SiN layer is relatively weak due to the lack of a suitable adhesion mechanism between the layers and the difference in thermal expansion coefficient of the layers. The adhesion layer 70 is believed to form a compound interface or diffusion interface between the dielectric layer 68 and the cavitation layer 72. As described above, the printhead 40 also includes an insulating layer or dielectric layer 74, a second metal conducting layer 76 and a nozzle plate 44 (FIG. 2) or nozzle plate 60 and thick film layer 56 (FIG. 3).

Referring now to FIG. 3, an alternative embodiment of the invention will be described in more detail. As before, the heater chip 58 includes a semiconductor substrate 12, preferably made of silicon, an insulating layer 14, preferably made of silicon dioxide, a resistive layer 64, and a first metal conductive layer 18 as set forth above with respect to FIG. 2. However, unlike heater chip 42, heater chip 52 contains a dielectric layer 78 that is deposited on the first metal conductive layer 18 and heater resistor 66 and underlies a second insulating layer 74. In this embodiment, the dielectric layer 78 may be selected from SiC/SiN, DLC or doped-DLC as described above. As described above, an adhesion layer 70 is deposited or grown on a portion of the dielectric layer 78 to promote adhesion of the cavitation layer 72 to the dielectric layer 78.

Figure 4:
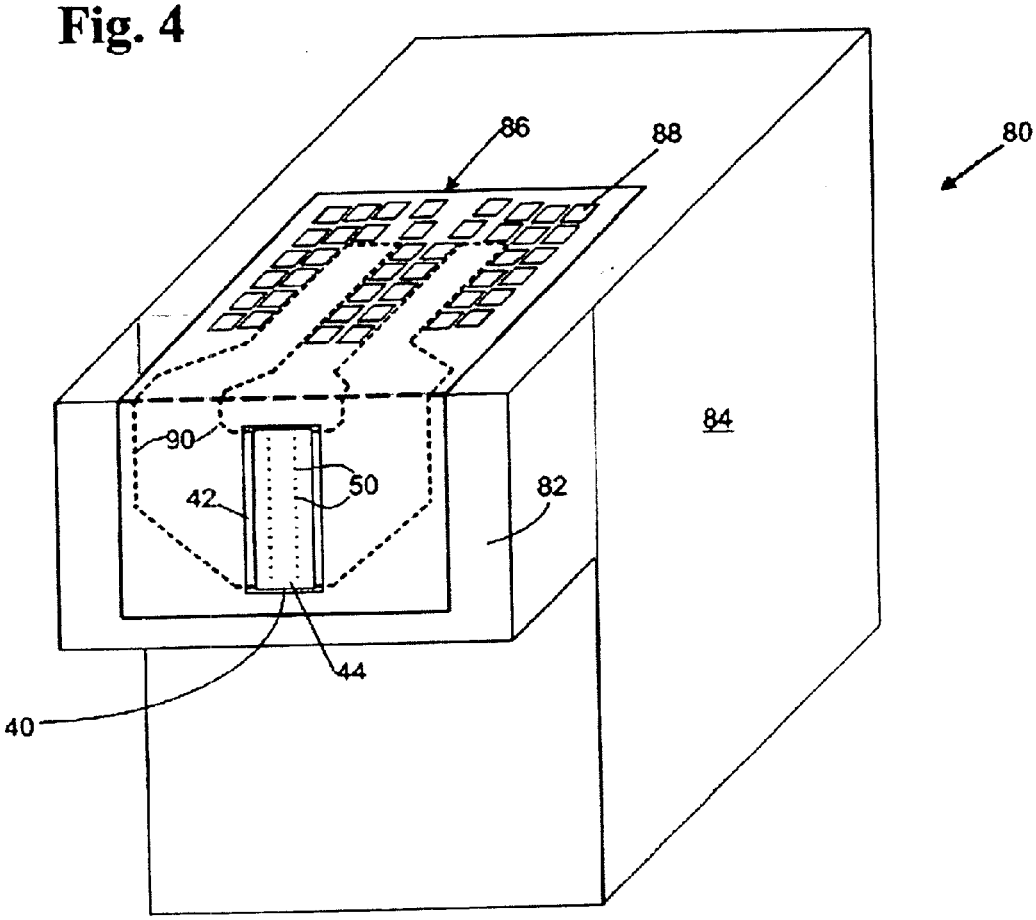
FIG. 4 is a perspective view, not to scale, if an ink jet cartridge containing a printhead according to the invention.

With reference to FIG. 4, an ink jet printer cartridge 80 containing a printhead 40 according to the invention is illustrated. The printhead 40 includes a heater chip 42 having a nozzle plate 44 containing nozzle holes 50 attached thereto. The printhead 40 is attached to a printhead portion 82 of the printer cartridge 80. The main body 84 of the cartridge 80 includes an ink reservoir for supply of ink to the printhead 40. A flexible circuit or tape automated bonding (TAB) circuit 86 containing electrical contacts 88 for connection to a printer is attached to the main body 84 of the cartridge 80. Electrical tracing 90 from the electrical contacts 88 are attached to the heater chip 42 to provide activation of ink ejection devices on the heater chip 42 on demand from a printer to which the ink cartridge 80 is attached. The invention however, is not limited to ink cartridges 80 as described above as the printheads 40 and 57 according to the invention may be used in a wide variety of ink cartridges.

Figure 5:
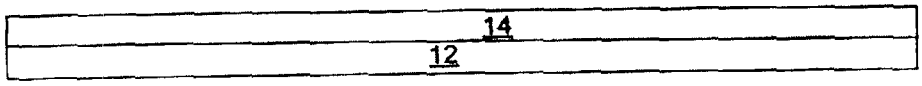
FIGS. 5–14 are cross-sectional views, not to scale, of steps for making a printhead according to the invention.

A method for making printhead chip 40 according to the invention is illustrated in FIGS. 5–14. Conventional microelectronic fabrication processes such as physical vapor deposition (PVD), chemical vapor deposition (CVD), or sputtering may be used to provide the various layers on the silicon substrate 12. Step one of the process is shown in FIG. 5 wherein an insulating layer 14, preferably of silicon dioxide is formed on the surface of the silicon substrate 12.

Figure 6:
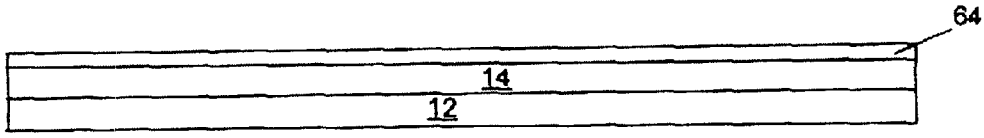

Next, a resistive layer 64 is deposited by conventional sputtering technology on the insulating layer 14 as shown in FIG. 6. The resistive layer 64 is preferably made of TaAl, but any of the materials described above may be used for the resistive layer.

Figure 7:
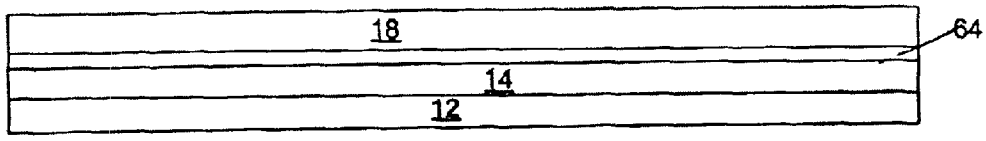
Figure 8:
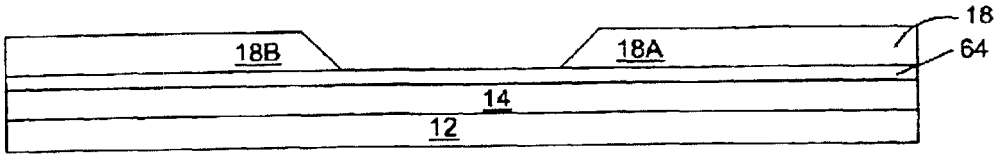

A first metal conductive layer 18 is then deposited on the resistive layer 64 as shown in FIG. 7. The first metal conductive layer 18 is preferably etched to provide ground and power conductors 18A and 18B and to define the heater resistor 66 as shown in FIG. 8.

Figure 9:
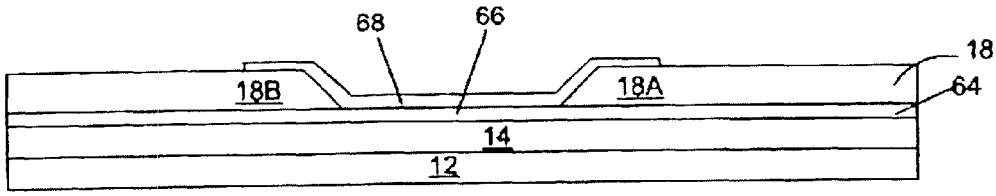
Figure 10:
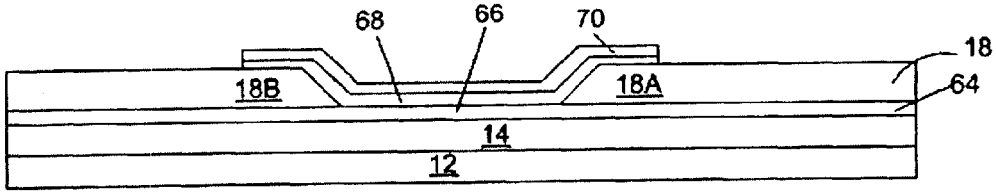
Figure 11:
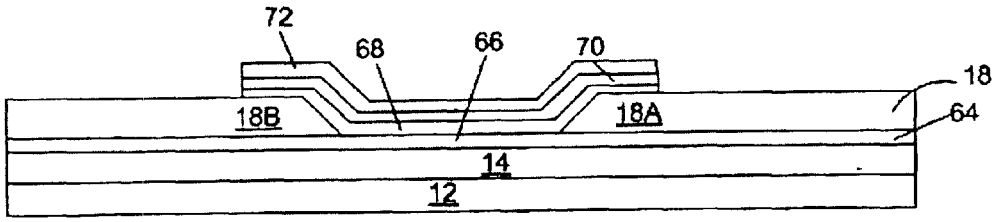

In order to protect the heater resistor 66 from corrosion and erosion, a first dielectric layer 68 made of SiC/SiN, DLC or doped-DLC is deposited on the heater resistor 66 as shown in FIG. 9. Prior to depositing a cavitation layer 72 in the heater resistor 66 area, an adhesion layer 70 is inserted onto the dielectric layer 68 as shown in FIG. 10. The adhesion layer 70 may be inserted by depositing the adhesion layer 70 on the dielectric layer 68, or as described in more detail below, by growing in the adhesion layer 70 on a dielectric layer 68 made of DLC during a process for depositing the DLC on the insulating layer 14. The cavitation layer 72 is then deposited on the adhesion layer 70 as shown in FIG. 11.

Figure 12:
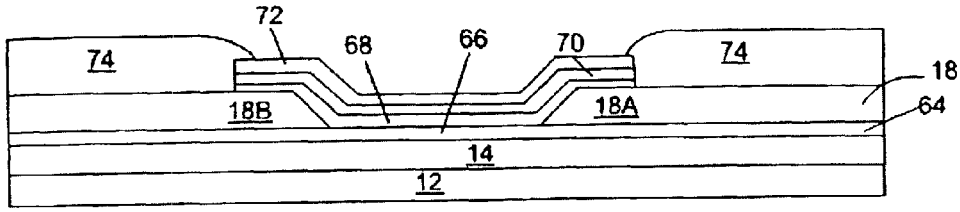
Figure 13:
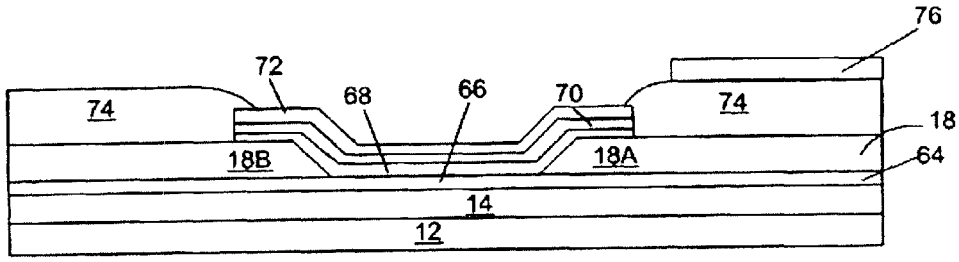
Figure 14:
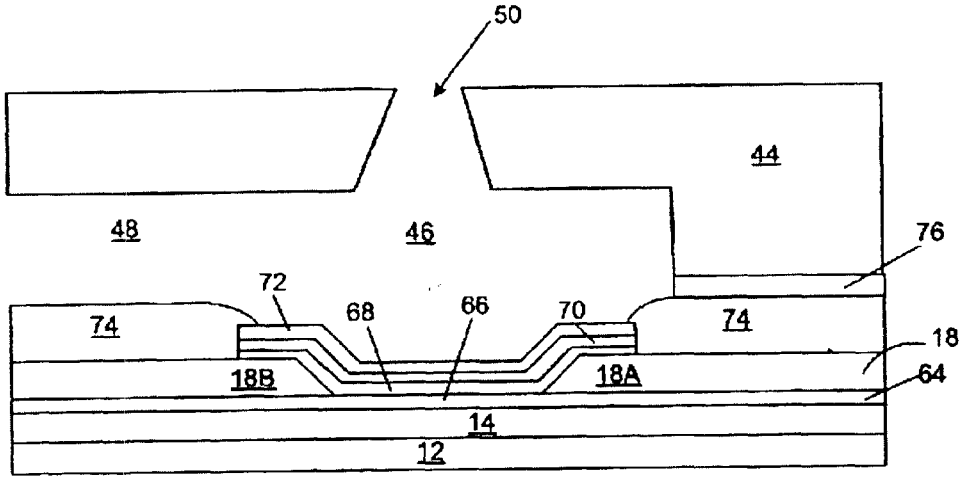

A second dielectric layer or insulating layer 74 is then deposited on exposed portions of the first metal layer 18 and preferably overlaps the first dielectric layer 68, adhesion layer 70, and cavitation layer 72 as shown in FIG. 12. The second metal conductive layer 76 is then deposited on the second insulating layer 74 as shown in FIG. 13 and is in electrical contact with conductor 18A. Finally, a nozzle plate 44 is attached as by an adhesive to the heater chip 42 as shown in FIG. 14 to provide printhead 40.

In another embodiment, adhesion is increased by modifying the dielectric layer 68 or 78 during a substantially continuous deposition process for the dielectric layer, particularly when the dielectric layer is Si-doped-DLC. According to the method, after the majority of a Si-DLC layer is deposited, the reactant which acts as the source of carbon, typically methane, ethane, or other simple hydrocarbon, is shut off and nitrogen gas is introduced into the DLC deposition chamber while maintaining the plasma. The nitrogen gas reacts with a source of silicon, typically tetramethylsilane, and continues to be introduced into the chamber to form a new hybrid film containing SiC and SiN components with none of the DLC characteristics. Other gasses which produce nitrogen, such as $NH_3$, may be also be used to generate nitrogen ions. The new hybrid film acts as an adhesion promoter for the subsequent deposition of a cavitation layer 72. By use of the foregoing process, the hybrid film layer may be applied as a very thin layer to the dielectric layer 68 or 78. The very thin hybrid film layer preferably has a thickness of less than about 200 Angstroms, preferably from about 100 to about 200 Angstroms.

In the following example, a Si-doped DLC layer and adhesion layer was formed in a substantially continuous process.

EXAMPLE

A 6 inch diameter silicon wafer was placed in a chemical vapor deposition chamber. In order to form a layer of Si-doped DLC on the silicon wafer, tetramethysilane gas was flowed into the chamber at 100 standard cubic centimeters per minute (sccm). Methane gas was also flowed into the chamber at 100 sccm. The chamber pressure was maintained at about 50 millTorrs. The RF power during the deposition process was 600 watts at an RF frequency of 13.6 Khz and the substrate bias voltage was 300 to 700 volts. The substrate was maintained at room temperature and the deposition rate for the process was 4200 Angstroms per minute. The Si-doped DLC layer was formed in about 30 seconds. The resulting Si-doped DLC had a film refractive index of 2.4 to 2.5 and a film stress of $-5$ to $-7\times10^9$ dynes/cm$^2$.

Upon completion of the formation of the Si-doped DLC layer, the methane gas flow was discontinued and the tetramethylsilane flow rate was decreased to 50 sccm. Nitrogen gas at a flow rate of 900 sccm was introduced into the chamber in place of the methane gas. The RF power was raised to 900 watts at the same RF frequency and the substrate bias voltage was increased to 600 to 800 volts. The substrate was maintained at room temperature during the deposition process which was conducted at a deposition rate 4000 Angstroms per minute until the desired adhesion layer thickness was formed. The resulting adhesion layer film had a refractive index of 2.0 to 2.1 and a film stress of $-4\times10^9$ dynes/cm$^2$.

While specific embodiments of the invention have been described with particularity herein, it will be appreciated that the invention is applicable to modifications, and additions by those skilled in the art within the spirit and scope of the appended claims.

What is claimed is:

1. An ink jet printhead for an ink jet printer comprising a nozzle plate attached to a heater chip, the heater chip including a semiconductor substrate, a resistive layer deposited on the substrate, a dielectric layer deposited on the resistive layer, a cavitation layer for contact with ink, and an adhesion layer between the dielectric layer and cavitation layer, wherein the dielectric layer is selected from the group consisting of silicon carbidelsilicon nitride (SiC/SiN), diamond-like carbon (DLC), and doped DLC, the cavitation layer is selected from the group consisting of tantalum (Ta), titanium (Ti), and platinum (Pt), and the adhesion layer is selected from the group consisting of tantalum nitride (TaN), tantalum oxide (TaO), silicon nitride (SiN), and titanium nitride (TiN), provided the adhesion layer and cavitation layer are selected so that the adhesion layer has no elemental component in common with the cavitation layer when the dielectric layer is comprised of SiC/SiN.

2. The printhead of claim 1 further comprising a thick film layer containing ink flow features attached to the chip between the nozzle plate and the chip.

3. The printhead of claim 1 wherein the substrate includes an insulating layer disposed thereon and the resistive layer is deposited on the insulating layer.

4. The printhead of claim 1 wherein the adhesion layer has a thickness ranging from about 100 to about 1000 Angstroms.

5. The printhead of claim 1 wherein the adhesion layer is a reaction product of silicon-doped DLC and nitrogen.

6. The printhead of claim 1 wherein the cavitation layer comprises tantalum and the adhesion layer comprises silicon nitride.

7. The printhead of claim 6 wherein the dielectric layer is selected from the group consisting of DLC and doped-DLC.

8. The printhead of claim 1 wherein the cavitation layer comprises titanium and the adhesion layer comprises tantalum nitride.

9. The printhead of claim 8 wherein the dielectric layer is selected from the group consisting of DLC and doped-DLC.

10. A method for enhancing adhesion between a dielectric layer and a cavitation layer of an ink jet printhead heater chip comprising the steps of: providing a semiconductor substrate, depositing an insulating layer on the substrate, the insulating layer having a thickness ranging from about 8,000 to about 30,000 Angstroms, depositing a resistive layer on the insulating layer, the resistive layer have a thickness ranging from about 500 to about 1,500 Angstroms and being selected from the group consisting of TaAl, Ta.sub.2N, TaAl(O,N), TaAlSi, TaSiC, Ti(N,O), WSi(O,N), TaAlN, and TaAl/Ta, depositing a first metal layer on the insulating layer and etching the first metal layer to define ground and address electrodes and a heater resistor therebetween, depositing a dielectric layer on the heater resistor, the dielectric layer having a thickness ranging from about 1000 to about 8000 Angstroms and being selected from the group consisting of silicon carbide/silicon nitride (SiC/SiN), diamond-like carbon (DLC), and doped-DLC, inserting an adhesion layer on the cavitation layer, the adhesion layer having a thickness ranging from about 100 to about 1000 Angstroms and being selected from the group consisting of tantalum nitride (TaN), tantalum oxide (TaO), silicon nitride (SiN), and titanium nitride (TiN), and depositing a cavitation layer on the adhesion layer, cavitation layer having a thickness ranging from about 1,500 to about 8,000 Angstroms and being selected from the group consisting of tantalum (Ta), titanium (Ti), and platinum (Pt), wherein the adhesion layer and cavitation layer are selected so that adhesion layer has no elemental component in common with cavitation layer when the dielectric layer comprises SiC/SiN.

11. The method of claim 10 wherein the adhesion layer is inserted by reacting a component used in forming a dielectric layer of Si-doped-DLC with a nitrogen containing compound under conditions and for a period of time sufficient to form a nitride containing layer having a thickness ranging from about 100 to about 200 Angstroms.

12. The method of claim 10 wherein the dielectric layer comprises DLC or doped-DLC, the cavitation layer comprises tantalum and an adhesion layer of silicon-nitride is deposited on the dielectric layer.

13. The method of claim 10 wherein the dielectric layer comprises silicon carbide deposited on silicon nitride, the cavitation layer comprises tantalum and an adhesion layer of titanium nitride is deposited on the silicon carbide.

14. A printhead containing a heater chip made by the method of claim 10.

* * * * *